United States Patent [19]

Stahl et al.

[11] 4,233,478

[45] Nov. 11, 1980

[54] CIRCUIT TRANSFER APPARATUS

[75] Inventors: John M. Stahl, Downers Grove; Robert W. DeRoss, Cicero, both of Ill.

[73] Assignee: Bunker Ramo Corporation, Oak Brook, Ill.

[21] Appl. No.: 823,921

[22] Filed: Aug. 12, 1977

[51] Int. Cl.[2] ..... H01R 33/30; H05B 9/06

[52] U.S. Cl. ..... 200/51.09; 200/1 A; 219/10.55 B

[58] Field of Search ..... 200/51.9, 51 R, 1 A, 200/1 R, 1 B, 283, 293, DIG. 46; 219/10.55 B, 10.55 E

[56] References Cited

U.S. PATENT DOCUMENTS

| | | | |
|---|---|---|---|
| 3,202,953 | 8/1965 | Bosworth et al. | 200/51.09 X |
| 3,204,053 | 8/1965 | Bilek | 200/51.09 |
| 3,225,155 | 12/1965 | Duncan | 200/51.09 |
| 3,272,929 | 9/1966 | Hacker | 200/1 R |
| 4,081,645 | 3/1978 | Javes et al. | 200/10.55 B |

*Primary Examiner*—Arthur T. Grimley

*Attorney, Agent, or Firm*—F. M. Arbuckle; W. Lohff; T. Haller

[57] ABSTRACT

Circuit transfer apparatus is described for use in transferring from time-responsive control to temperature-responsive control, and vice-versa, in a microwave oven. The low cost, miniaturized apparatus is mounted to the wall of the oven's cooking cavity and is operated from within the cavity by insertion or withdrawal of the cable plug of the heat-sensitive food probe. The probe plug cooperates with insulative elements to activate spring-leaf sheet metal contacts mounted in the housing of the apparatus, to thereby effect the circuit transfer. The housing also serves as mechanical retention means for the probe plug.

20 Claims, 8 Drawing Figures

CIRCUIT TRANSFER APPARATUS

BACKGROUND OF THE INVENTION

The present invention relates to electrical circuit transfer apparatus and, more particularly, to apparatus used to transfer between time-responsive and temperature-responsive circuitry used to control the operation of a microwave oven.

The use of temperature-monitoring apparatus in microwave ovens is well known. U.S. Pat. No. 3,975,720 illustrates one conventional arrangement of such apparatus, including a temperature-sensitive probe having a thermistor mounted in its tip and circuitry responsive to thermally-induced changes in the resistance of the thermistor to control the cooking operation of the oven or to activate an enunciator. The probe is connected to the oven's operating circuitry by a shielded cable and a plug which mates with a connector in the oven wall. A disadvantage associated with this particular arrangement is that separate means are required to transfer between the temperature-responsive circuitry and the time-responsive circuitry when the probe is used in an oven also having a conventional timing control. It is possible, therefore, to inadvertantly use the wrong control mode when cooking with the oven by failing to properly set the transfer means to interconnect either the time-responsive or temperature-responsive circuitry to the microwave energy generator of the oven.

In order to overcome this deficiency some prior art microwave ovens utilize circuit transfer apparatus which function in response to insertion or withdrawal of the probe cable plug into or from the connector mounted on the oven wall. Such prior art transfer apparatus typically include a retention jack which holds the plug and one or more separate micro switches which effect the circuit transfer. It is believed that all prior art transfer apparatus of this type employ commercially available micro switches rated to accept the full 15 amp current required to drive the microwave energy generator of the oven. In addition, these apparatus require relatively complex mounting structures to properly align the jack and separate micro switches, thereby increasing both the cost and the size of the device.

An alternative prior art transfer apparatus of this same general type uses plug acuated electronic circuitry to effect the circuit transfer. Of course, such apparatus is relatively expensive and, again, employs plug retaining structure separate from the circuit transfer means.

SUMMARY OF THE INVENTION

Therefore, the present invention is directed to circuit transfer apparatus associated with both the time-responsive and temperature-responsive control circuitry of a microwave oven and which overcomes the problems and deficiencies of the prior art discussed hereinabove. Moreover, the fact that insertion or withdrawal of the probe cable plug can only occur in the no-power condition, i.e., with the door to the oven and its associated breaker switch open, is recognized and used to significant advantage. Thus, the circuit transfer apparatus of the present invention does not employ circuit transfer means capable of continuous reliable operation in the powered condition. Rather, low cost and miniaturized transfer means are used which have only limited power-on transfer capability and which are readily mounted in conjunction with a plug retaining structure to form a unitary and compact circuit transfer apparatus assembly. The assembly is mounted to the wall of the oven and is interposed in the oven's electrical circuitry between the power supply and the microwave energy generator, avoiding the need for any separate switching devices or circuit transfer circuitry.

In accordance with a preferred embodiment of the invention, circuit transfer means are employed comprising a double-pole, double-throw jack and plug arrangement for controlling the operating modes of a microwave oven. The jack electrically interconnects the microwave energy generator of the oven with both time-responsive and temperature-responsive electrical circuitry for controlling the operating modes of the oven such that the jack regulates which control circuitry is operative. A breaker switch associated with the oven door is integrated in the system between the jack and the power source to insure de-energization of the circuit system prior to insertion or withdrawal of a plug into or from the jack. Thus, current flows through the system only after the plug has been completely inserted within or completely withdrawn from the jack and the door is closed. The jack is constructed so that one mode of operation of the oven is operative without the presence of the plug, and a second mode of operation is operative when the plug has been completely inserted in the jack.

The jack of the present invention preferably includes a housing having an interior cavity which includes means for removably retaining the plug within the cavity when the plug is inserted therein. The receiving means is adapted to electrically engage the outer surface of the plug and is in turn electrically engaged with a ground contact member projecting from the jack housing. The plug retaining means is also adapted to electrically engage the end of the plug, the retaining means being part of a retaining contact element which projects from the jack housing. Inasmuch as the plug's outer surface and the plug's end provide two separate and distinct electrical contacts, a plug circuit is formed when the plug is inserted within the jack, the plug circuit interconnected to the temperature-responsive control circuitry of the microwave oven.

The jack further includes main circuit contact means including a a plurality of specially constructed first and second contact members disposed within the housing. The first contact members are electrically engageable with selected second contact members and are electrically isolated from each other by insulating means which may move with the first contact members. Preferably, each first contact member is electrically engageable with and movable between two adjacent second contact members to provide alternate circuit paths for the power supply of the microwave energy generator. The insulating spacers may include one spacer disposed between the main circuit contact means and the retaining means so that the plug engages such spacer as the plug is inserted into the jack housing. In this manner, the movements of the plug into or from the housing are translated into movements of the first contact members so that one circuit path is formed when the plug is inserted within the jack and an alternate circuit path is formed when the plug is absent from the jack. The main circuit paths electrically connect the microwave energy generator to the time-responsive and temperature-responsive control circuitry. Thus, the main circuit contact means regulates the operating modes of the microwave oven.

The contact members are mounted within the jack housing such that longitudinal or lateral displacement of the contact members is substantially eliminated. Furthermore, the insulating spacers are disposed within the jack housing to eliminate the possibility of arcing or short-circuiting between the contact members when the circuit system is energized regardless of the current load, and the possibility of short-circuiting between the contact members as the plug is inserted or withdrawn from the jack is obviated due to the presence of the power supply breaker switch. Therefore, a high current load necessary to power the microwave energy generator may be passed directly through the jack of the present invention.

BRIEF DESCRIPTION OF THE DRAWINGS

The novel features which are believed to be characteristic of the invention are set forth in the appended claims. The invention itself, however, together with further objects and attendant advantages thereof, will be apparent and best understood from the following detailed description taken in connection with the accompanying drawings, setting forth by way of illustration and example certain embodiments of the invention, in which:

DETAILED DESCRIPTION OF THE PREFERRED EMBODIMENTS

Figure 1:
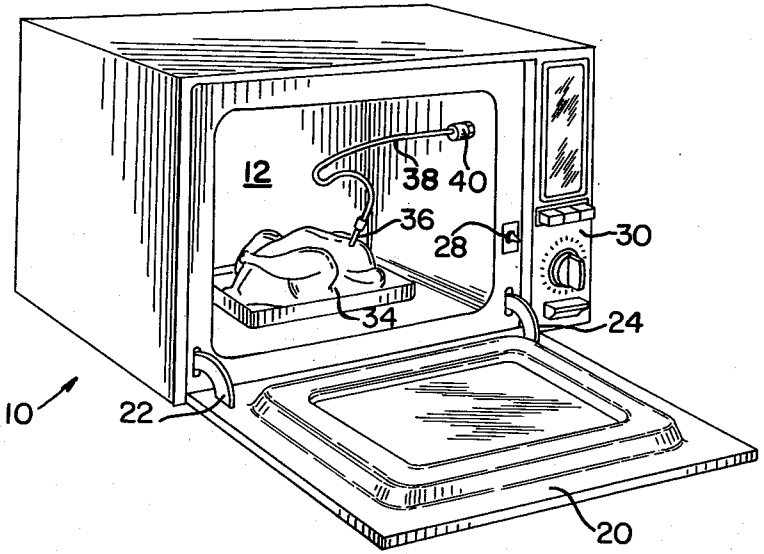
FIG. 1 is a perspective view of a microwave oven shown with its oven door open and illustrating a temperature-sensitive probe connected by way of a cable to an end plug which is inserted into a wall mounted jack constructed in accordance with the present invention.

Referring first to FIG. 1, a conventional microwave oven 10 is illustrated and includes an interior cooking cavity 12 defined by sidewalls, a bottom, a top and a door 20. The door 20 is swingingly mounted by any conventional means such as hinges 22 and 24 to provide access to the interior cooking cavity 12. It should be understood that oven 10 is shown for purposes of illustration only, and that any conventional microwave oven may be utilized in conjunction with the present invention.

Disposed on the door jamb of the oven is a breaker switch 28 which, as described in greater detail below, interrupts the current flow and de-energizes the microwave energy generator when ever door 20 is open and the interior cooking cavity 12 is accessible. Also provided is a control panel 30 utilized in adjusting the temperature and time of cooking and is therefore utilized in both the time-responsive and temperature-responsive operating modes of the microwave oven 10.

Within the interior cooking cavity 12, there is illustrated a shallow container constructed of a material transparent to microwaves, such as a Pyrex dish, containing a comestible. As is conventional in many microwave ovens, the comestible may be cooked at a preset temperature for a preset time and thereby cooked according to a time-responsive operating mode, or it may be cooked by an alternative method whereby a temperture-sensitive probe 36 is inserted into the comestible. The probe 36 is electrically connected to a flexible shielded cable 38, the opposite end of the cable 38 being connected to an electrical plug 40 which is inserted within and electrically engaged with an electrical jack (not shown) mounted in the sidewall of the microwave oven 10. This alternate method of cooking the food 34 is a temperature-responsive operating mode controlled by the internal temperature of the comestible as measured by the temperature-sensitive probe 36. The probe 36 generally includes a thermistor (not shown) as the temperature-sensitive element, as described in greater detail and only by way of example in the above-mentioned U.S. Pat. No. 3,975,720. Additional details regarding microwave oven circuitry for the temperature cooking operating mode may also be obtained from the disclosure of this patent and are incorporated herein by reference.

Figure 2:
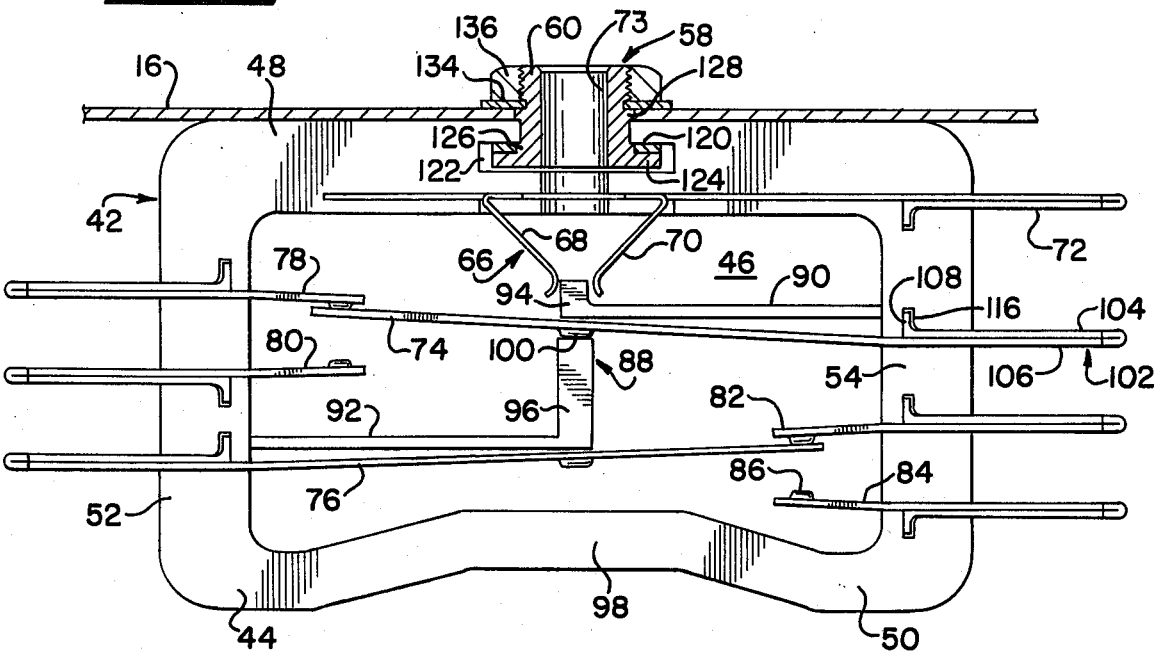
FIG. 2 is an enlarged side elevational view, in partial section, illustrating one embodiment of an electrical jack constructed in accordance with the present invention.
Figure 3:
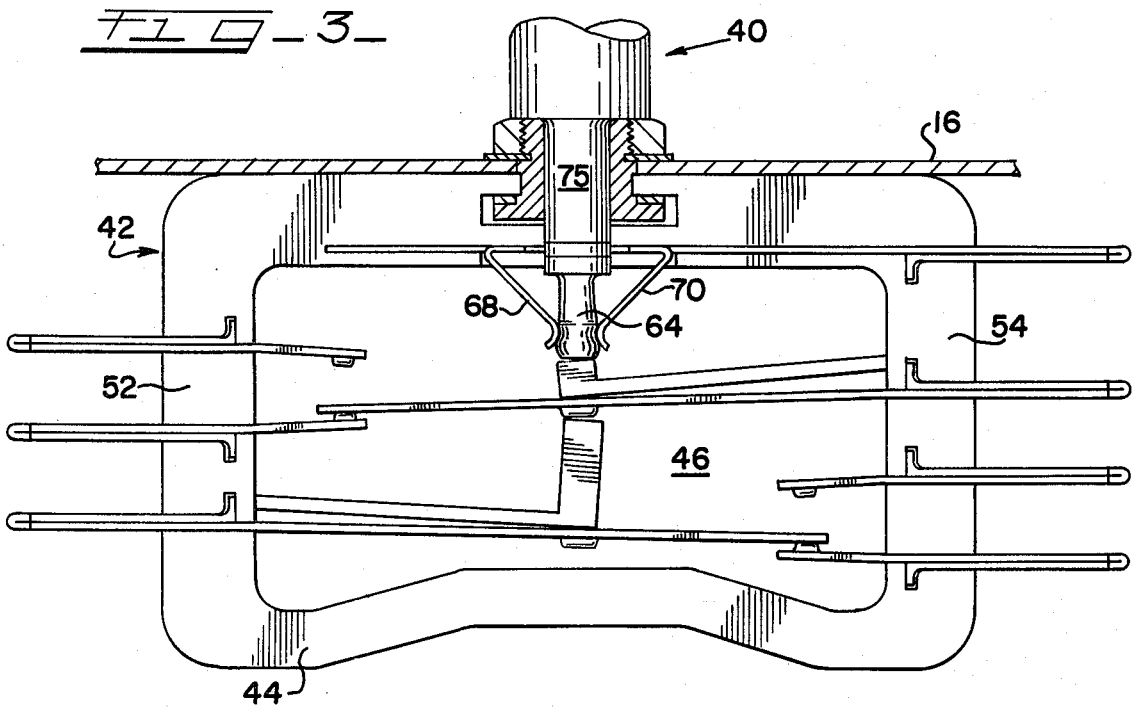
FIG. 3 is a view similar to FIG. 2 but illustrating the jack and contact member configuration with a plug inserted within the jack.
Figure 4:
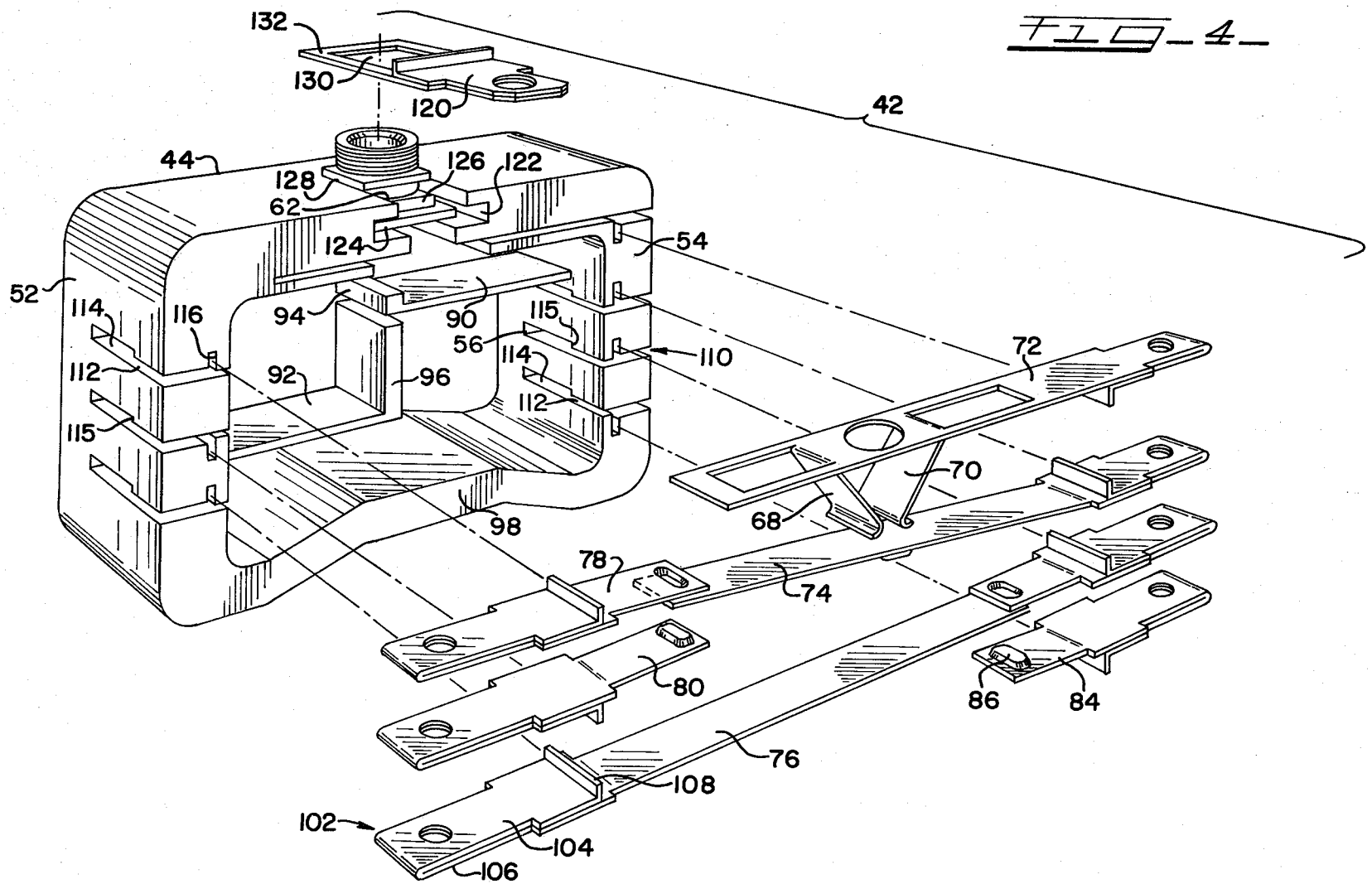
FIG. 4 is an exploded perspective view of the embodiment of the jack illustrated in FIG. 2.

Turning to FIGS. 2 through 4, one embodiment of a jack constructed in accordance with the present invention is illustrated. The jack 42 is shown secured to the interior sidewall 16 of a microwave oven (not illustrated), and includes a housing 44 having an interior cavity 46 defined by top wall 48, bottom wall 50 and sidewalls 52 and 54. The housing 44 may be constructed from any known dielectric material, and preferably a plastic capable of withstanding a high temperature environment.

Means 58 for receiving the male plug 40 within the cavity 46 preferably include a nickel plated copper alloy guide bushing 60 secured within an aperture 62 (best shown in FIGS. 4 and 6) which passes through the top 48 of the housing 44 and opens at one end into the cavity 46 and at its other end into the interior cooking cavity 12 of a microwave oven 10 when mounted on the wall 16. As the plug 40 is inserted through bushing 60 into the cavity 46, the electrically conductive end 64 of the plug 40 is retained within the cavity 46 by retention means 66 which, in the illustrated embodiment, comprises two angularly inclined opposed clips 68, 70. Preferably, the clips 68, 70 are portions of a retention contact member 72 which is embedded in the top 48 of the housing 44 and extends out through the sidewall 54 of the housing 44. The opposed clips 68, 70 are formed from the interior portion of the contact element 72 and depend downwardly toward each other and toward the central axis of the bushing 60 so that the ends of the clips 68, 70 are disposed immediately below the central opening 73 of the bushing 60. The ends of the clips 68 and 70 are spaced apart so that as the end 64 of the plug 40 is inserted into the housing cavity 46, the plug end 64 contacts and forces the ends of the clips 68 and 70 apart so that clips 68 and 70 are thereby biased against the end 64 of the plug 40 within the cavity 46. Furthermore, the clips 68 and 70 and the retention contact 72 are all electrically conductive so that the clips 68 and 70 electrically engage the end 64 of the plug 40. It should be noted that the clips 68 and 70, the retention contact member 72, and all other contact members mentioned hereinafter are preferably constructed from an electrically conductive copper alloy. it should also be noted that in the illustrated embodiments, the exterior surface 75 of the plug 40 is insulated from the end 64.

The jack 42 also includes a plurality resilient first contact members 74, 76 and a plurality of paired second contact members 78, 80 and 82, 84. Each second contact member 78–84 preferably includes an electrically conductive contact element 86 disposed on its free end located within the cavity 46 for engagement with the free end of a first contact member 74 or 76. As illustrated in FIGS. 2–4, the first and second contact members 74–84 are arranged so that the first contact member 76 extends through the sidewall 52 of the housing 44 and substantially across the cavity 46 so that its free end is interposed between the second contact members 82 and 84 which extend through the sidewall 54 of the housing 44. In this manner, the resilient first contact member 76 may alternately engage the contact element 86 of either the second contact member 82 or the second contact member 84. Similarly, the resilient first contact member 74 extends through the sidewall 54 of the housing 44 and substantially across the cavity 46 so that its free end is interposed between the contact elements 86 of the second contact members 78 and 80 which extend through the sidewall 52 of the housing 44. The first contact member 74 thus alternately engages the free ends of the second contact members 78 and 80.

It should be noted that the first and second contact members 74–84 need not necessarily extend through the opposed sidewalls 52, 54. For example, the first contact member 74 and the second contact members 82 and 84 could extend through the back wall 56 so as to be at substantially right angles to the first contact member 76 and the second contact members 78 and 80. Any such alternate arrangement of the contact members 74–84 is deemed to be within the scope of the present invention. Furthermore, the first and second contact members 74–84 preferably comprise leaf-spring contacts having sufficient resiliency so as to be capable of deflection without producing undue stress or permanent deformation therein. Also, the portion of each second contact members 78, 80 and 82, 84 disposed within the cavity 46 is preferably angled slightly toward its paired second contact member, and the interior portions of the first contact members 74 and 76 disposed within the cavity 46 are preset to engage the second contact members 78 and 82, respectively, when the plug 40 is not present within the jack 42.

As illustrated in FIG. 2, the normal or unmated positions of the plug 40 and the jack 42 are such that first contact member 74 is resiliently biased against the contact element 86 of the second contact member 78, while the free end of the first contact member 76 is resiliently biased against the contact element 86 of the second contact member 82, thereby creating a first circuit path for the main circuit through the jack housing 42. After insertion of the plug 40, the first contact member 74 is forced against the contact element 86 of the second contact member 80, while the first contact member 76 is likewise forced against the contact element 86 of the second contact member 84 to create a second circuit path for the main circuit within the jack 42.

To move the first contact members 74 and 76 between alternate second contact members 78–84 and to prevent short-circuiting or arcing between the first contact members 74, 76, means 88 are provided for electrically isolating the first contact members 74 and 76 from each other and for transferring the movements of the plug 40 to the first contact members 74, 76. To achieve this function and in the embodiment illustrated in FIGS. 2–4, the means 88 comprise an insulating flexible projection member 90 extending from the interior surface of the sidewall 54 to the central axis of the bushing 60 and disposed above the first contact member 74, and an insulating flexible projection member 92 secured to the inner surface of sidewall 52 and extending to the center axis of the bushing 60 immediately above the first contact member 76. Disposed at the end of the member 90 is an insulating spacer 94, and disposed at the end of the member 92 is an insulating spacer 96. The projecting members 90 and 92 and the insulating spacers 94 and 96 may be constructed from any dielectric insulating material and is preferably constructed from the same material as the housing 44. The spacers 94 and 96 are both preferably aligned with the central axis of the bushing 60, and spacer 94 is positioned immediately below the ends of the clips 68 and 70 so as to engage the end 64 of the plug 40 as the plug is inserted into the housing 44. The insulating spacers 94, 96 are spaced apart such that the first contact members 74 and 76 are in contact with the spacers 94 and 96 so as to form a substantially unitary assembly. In this manner, as the plug 40 is inserted into the housing 44, there is a substantially simultaneous deflection of the first contact members 74 and 76 to engage the second contact members 80 and 84, respectively, thereby equalizing forces and travel of both the first contact members 74, 76. Likewise, when the plug 40 is withdrawn from the housing 44, there is a substantially simultaneous movement of the first contact members 74, 76 to engage the second contact members 78, 82, respectively. Furthermore, the bottom wall 50 of the housing 44 preferably includes an inward projection 98 aligned along the center axis of the bushing 60 to limit total travel of the first contact members 74, 76 and the spacers 94, 96, thereby preventing potential over-throw and over-stressing of the first contact members 74, 76 as well as over-stressing of the housing 44. In this manner, the circuit paths of the electrical circuit of which the first contact members 74 and 76 are a part may be quickly and easily changed so as to change the operating mode of the electrical load device to which the jack 42 is electrically connected.

To insure snug engagement between the first contact member 74 and the spacers 94, 96, a centrally disposed projecting bead 100 is provided on the bottom portion of the first contact member 74 in alignment with the spacers 94 and 96. This is preferred so that close tolerances in the formation of spacers 94 and 96 and projecting members 90 and 92 is unnecessary, yet the spacers 94, 96 and first contact members 74, 76 will move substantially as a unit when the contact members 74, 76 are in place within the housing 44. It should be noted that while the projecting members 90 and 92 may be constructed from any insulating dielectric material, they should be constructed so as to afford minimal resistance to movement thereof by the insertion of the plug 40, yet have sufficient strength to resist the temperatures reached in the surrounding environment due to the high electrical load passing between the first and second contact members.

The sidewalls 52, 54 of the housing 44 and the contact members 72–84 are all constructed to prevent any undesired displacement or movement of the contact members 74–84 within the housing 44. Since the construction of the ends of all the contact members 72–84 is preferably the same, only the construction for the first contact member 74 will be discussed in detail. To form the terminal end 102 of the first contact member 74 which extends through the sidewall 54 and outwardly therefrom, the first contact member 74 may be folded so that a double thickness terminal end 102 is formed, the folded portions 104 and 106 of end 102 tending to separate to a limited degree. Hence, a resilience is retained between the portions 104 and 106. The very end of the folded portion 104 is again folded upwardly so as to form a vertical tab 108 which is substantially perpendicular to the folded portion 104.

To mount each contact member within the housing 44, and with reference to the first contact member 74 only, a stepped slot 110 may be employed in the sidewall 54 of the housing 44. The slot 110 has a first open portion 112 which extends from the open front of the housing 44 toward the back of the housing 44. The slot 110 also has a second stepped open portion 114 which has a greater width than the first open portion 112 and extends from the first portion 112 toward the back wall 56. The difference in thickness between the first and the second portions 112, 114 provides a shoulder 115. Finally, a vertical channel 116 extends from the slot 110 upwardly through the sidewall 54 and is substantially perpendicular to the slot 110. To mount the first contact member 74, the folded portions 104, 106 are pressed together to their full extend, and the end 102 is slipped into the first open portion 112 with the vertical tab 108 fitting snugly into the vertical channel 116. The end 102 is then inserted further into the slot 110 so that the entire end 102 is disposed within the second open portion 114. The vertical tab 108 prevents longitudinal displacement of the first contact member 74, and since folded portions 104 and 106 tend to separate from each other, the shoulder 115 prevents lateral displacement of the first contact member 74 after the member 74 has been fully inserted within the slot 110. Furthermore, subsequent compression of the folded over portions 104 and 106 will not enable ready removal of the first contact member 74 from the second open portion 114. This is due to the flexibility of the portions of the sidewall 54 between the series of slots 110 which enables easy insertion of the contact members within the slots 110, but once all of the contact members 72–84 have been inserted into the housing 44, such flexibility is reduced, thereby preventing removal of the contact members 72–84 from the slots 110.

It should be noted that the above detailed description of the slot 110 and the first contact member 74 is substantially identical for all the slots within the housing 44 and the contact members therefor. Furthermore, it should be understood that any number of first contact members and second contact members may be utilized in the present invention and that the present invention is not limited to the embodiment illustrating two first contact members and two pairs of second contact members. Also, the present invention is not to be limited to alternate contact by the first contact member with the two second contact members. For example, an open circuit in lieu of a second circuit path may be desired so that only one second contact member is provided for a first contact member.

Other contact member constructions and slot configurations may be employed in the circuit transfer apparatus of the present invention. For example, the contact members may be fabricated from sheet metal stock having a stepped cross-sectional configuration. Thus, the resulting contact member will have a greater thickness at the terminal end to provide structural strength, and a thinner active contact portion to provide resilience, the folding of the terminal end being eliminated.

The retaining contact member 72 completes a circuit path which includes the contact member 72, the retaining means 66, the end 64 of the plug 40, the circuitry (not shown) attached to the plug 40, the exterior surface 75 of the plug 40, the bushing 60 and a bushing contact member 120 which is electrically connected to the exterior of the bushing 60 and to ground. This circuit, as described and illustrated in greater detail hereinbelow, is electrically integrated with the circuit path of the main circuit for the temperature-responsive operating mode of a microwave oven.

The receiving means 58 includes the bushing 60 to which the ground contact 120 is engaged within a space 122 in the top wall 48 of the housing 44. The illustrated bushing 60 has three stepped projections 124, 126 and 128 disposed exterior thereto. The ground contact 120 preferably includes an aperture 130 such that the edge portion 132 surrounding the aperture 130 of the ground contact 120 rests upon the upper surface of the projection 124 and against the outer edges of the projection 126 so as to be snugly secured within the space 122. The third projection 128 is spaced apart from the second projection 126 so as to overlap the outer surface of the top wall 48 of the housing 44 and is sized and shaped to fit an orifice (not shown) in the wall of the microwave oven 10 (FIG. 1) with the end of the bushing 60 projecting into the cavity 12 of the microwave oven 10.

To secure the jack 42 to the wall 16 of a microwave oven, the third projection 128 is snugly fitted within the orifice of the wall 16, and a washer 134 is disposed about the bushing 60 with a nut 136 being tightened down thereon. Alternatively, the nut 136 and washer 134 may be formed as an integral element. The configuration of the projections 124, 126 and 128 enables sifficient force to be applied by the nut 136 to hold the jack 42 in place, yet only a small amount of pressure is applied to the top 48 of the housing 44, the majority of the pressure being applied to the projection 128 by direct contact with the washer 134. This is preferred since the material from which the housing 44 is constructed tends to flow somewhat at elevated temperatures, and high compression of the housing 44 at the point where the bushing 60 is located would force the material of the top 48 to flow and thereby lossen the connection to the wall 16. It should be noted that the shape of the projections 124, 126 and 128 may be square to prevent rotation of the bushing 60 and thereby maintain the jack 42 in proper position. It should also be noted that the bushing contact member 120 may be connected to ground within a microwave oven in any desired and known manner.

Figure 5:
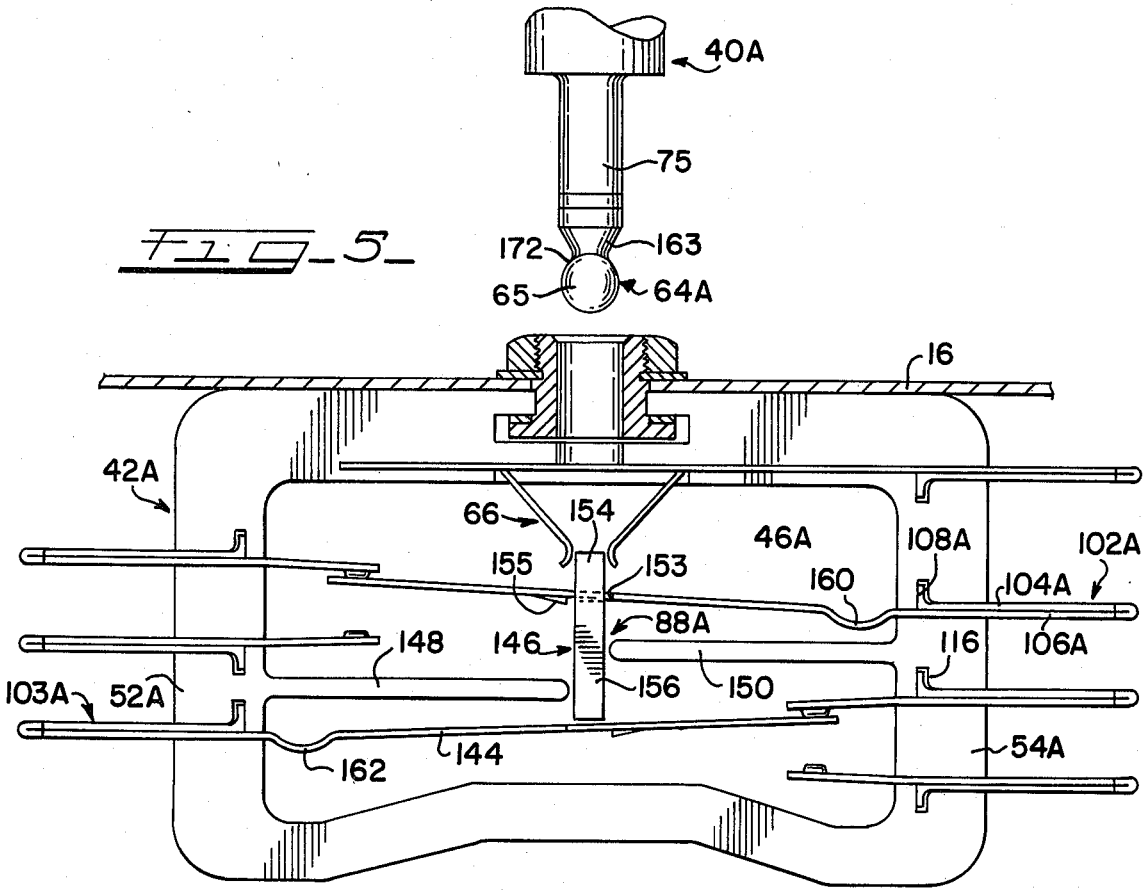
FIG. 5 is an enlarged side elevational view, in partial section, of a second embodiment of a jack constructed in accordance with the present invention.
Figure 6:
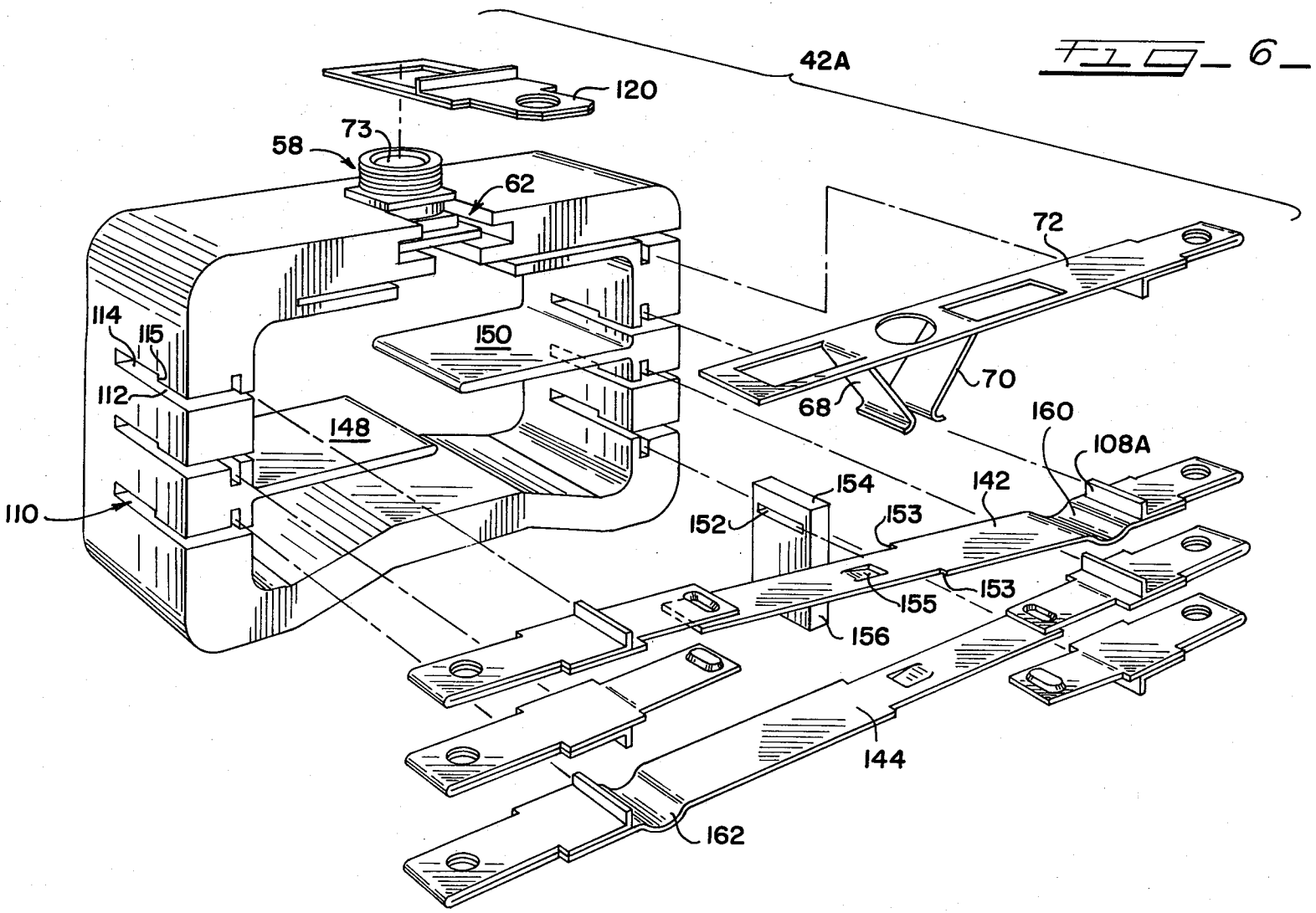
FIG. 6 is an exploded perspective view of the embodiment of the jack illustrated in FIG. 5.

Turning now to a second embodiment of a jack constructed in accordance with the present invention and as illustrated in FIGS. 5 and 6, it should be noted that like numerals are utilized for like parts throughout the specification and drawings. In FIGS. 5 and 6, the jack 42 A of the second embodiment includes a somewhat different shape for the first contact members 142 and 144, and a somewhat different means 88A for electrically isolating the first contact members 142, 144, and for transferring the movements of the plug 40A to the first contact members 142, 144. Furthermore, the plug 40A itself has a slightly different shape.

The means 88A for isolating the first contact members 142 and 144 comprises one large insulating spacer 146 and two flexible insulating projection members 148 and 150. The insulating spacer 146 preferably is a substantially rectangular block having a rectangular aperture 152 sized and shaped to snugly receive the first contact member 142 therethrough. In this manner, the spacer 146 may be slipped onto the contact member 142 and located along its length between abutments 153 and projection 155 so as to be aligned with the central axis of the bushing 60 when the first contact member 142 is inserted within the slot 110. The upper portion 154 of the spacer 146 is disposed between the first contact member 142 and the retention means 66 so as to engage the plug 40A when the plug 40A is inserted within the receiving means 58. The lower portion 156 of the spacer 146 is disposed between the first contact member 142 and an adjacent first contact member 144 and is sized so that the lowermost edge of the block portion 156 is in direct contact with the first contact member 144, the spacer 146 and the first contact members 142 and 144 moving substantially simultaneously as a unit when engaged and moved by the plug 40A as described in the previous embodiment.

The flexible projection members 148 and 150 of the isolating means 88A project from the inner surfaces of the housing sidewalls 52A and 54A, respectively, toward the central axis of the bushing 60 and are sized so that their inner ends are spaced apart from the insulating spacer 146. The projection member 148 is positioned to separate the first contact member 144 from the second contact member 80, and the projection member 150 is positioned to separate the first contact member 142 from the second contact member 82. In this manner, the insulating spacer 146 and the projection members 148 and 150 prevent any short-circuiting or arcing between the first set of contact members which comprise the first contact member 142 and the second contact members 78 and 80, and the second set of contact members which comprise the first contact member 144 and the second contact members 82 and 84. The projection members 148 and 150 are preferably of sufficient strength and thickness and are constructed of a material to be non-resilient and to resist the elevated temperatures within the housing 44A.

The first contact members 142 and 144 may have an indented or rippled portion 160 located along its length proximate its exterior end 102A inside sidewall 54A to increase the strength of the contact and to form a slight angle between the plane of the end 102A and the plane of the remaining part of the first contact member 142. The first contact member 144 also has a similarly indented or rippled portion 162 located near its end 103A inside sidewall 52A to form a slight upward angle between the plane of the end 102A and the plane of the remaining portion of the first contact member 144. These indented portions 160 and 162 and the resultant angles achieved thereby along the first contact members 142 and 144 create a greater contact force between the first contact members 142 and 144 and the second contact members 78 and 82, respectively. They also create a greater resistance force to the insertion of the plug 40A into the central cavity 46A of the housing 44A, which is desirable since the projection members 148 and 150 are not connected to the spacer 146 as is true in the embodiment illustrated in FIGS. 2 through 4. This amount of resistive force may be varied depending on the relative placement of the contact members within the jack housing 44A as well as the angle formed by the indented portions 160 and 162.

The plug 40A has a somewhat different shaped end 64A as compared to the previous embodiment. The end 64A includes a funnel-shaped neck 163 projecting from the cylindrical exterior surface 75 of the plug 40A and terminates in a ball 165, the junction between the neck 163 and the ball 165 forming an indented portion 172. The indented portion 172 is for receiving the ends of the retention means 66 or 66A, as described in detail below.

Figure 7:
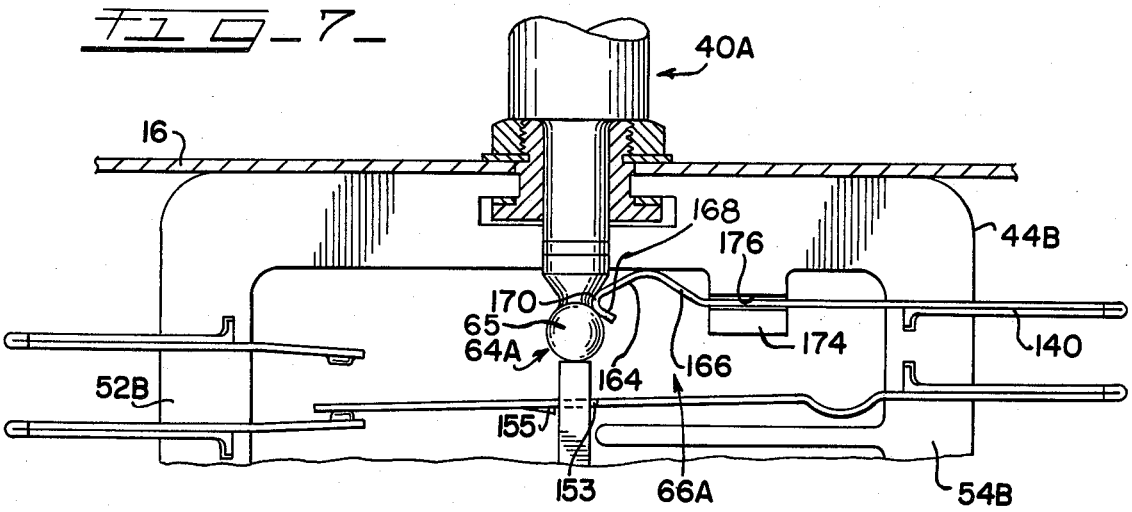
FIG. 7 is an enlarged partial front elevational view, in partial section, of a jack constructed in accordance with the present invention and specifically illustrating a second embodiment of the retention contact means of the jack of the present invention.

Referring to FIG. 7, a second embodiment of the retention means 66A is illustrated therein and includes an angularly inclined clip portion 164 disposed at the end of the retention contact member 140. The clip portion 164 preferably has a substantially U-shaped member 166 secured to the contact member 140 and a partial S-shaped member 168 secured to the end of the U-shaped member 166. As can be seen from FIG. 7, the contact point 170 of the S-shaped member 168 physically and electrically engages the end 64A of the plug 40A as the plug 40A is inserted within the housing 44B. When the plug 40A is completely inserted, the contact portion 170 becomes seated in the indented portion 172 of the plug end 64A, and the S-shaped portion 168 is forced toward the housing sidewall 54B. In this manner, electrical contact is made between the plug end 64A and the retention means 66A, and the bias force of the S-shaped portion 168 against the plug end 64A retains the plug 40A within the housing 44B until the plug 40A is intentionally removed therefrom. The retention contact member 140 may be mounted within the housing 44B as previously illustrated or as illustrated in FIG. 7 wherein the contact member 140 is inserted through the sidewall 54B and into a projecting support member 174. The support member 174 depends from the top 48A of the housing 44B into the cavity 46B and includes a slot 176 for receiving the retention contact member 140. The support member 174 provides a greater deflection force for retention means 66A as well as relieves the concentration of forces from the base of the contact member 140 at the sidewall 54B.

Figure 8:
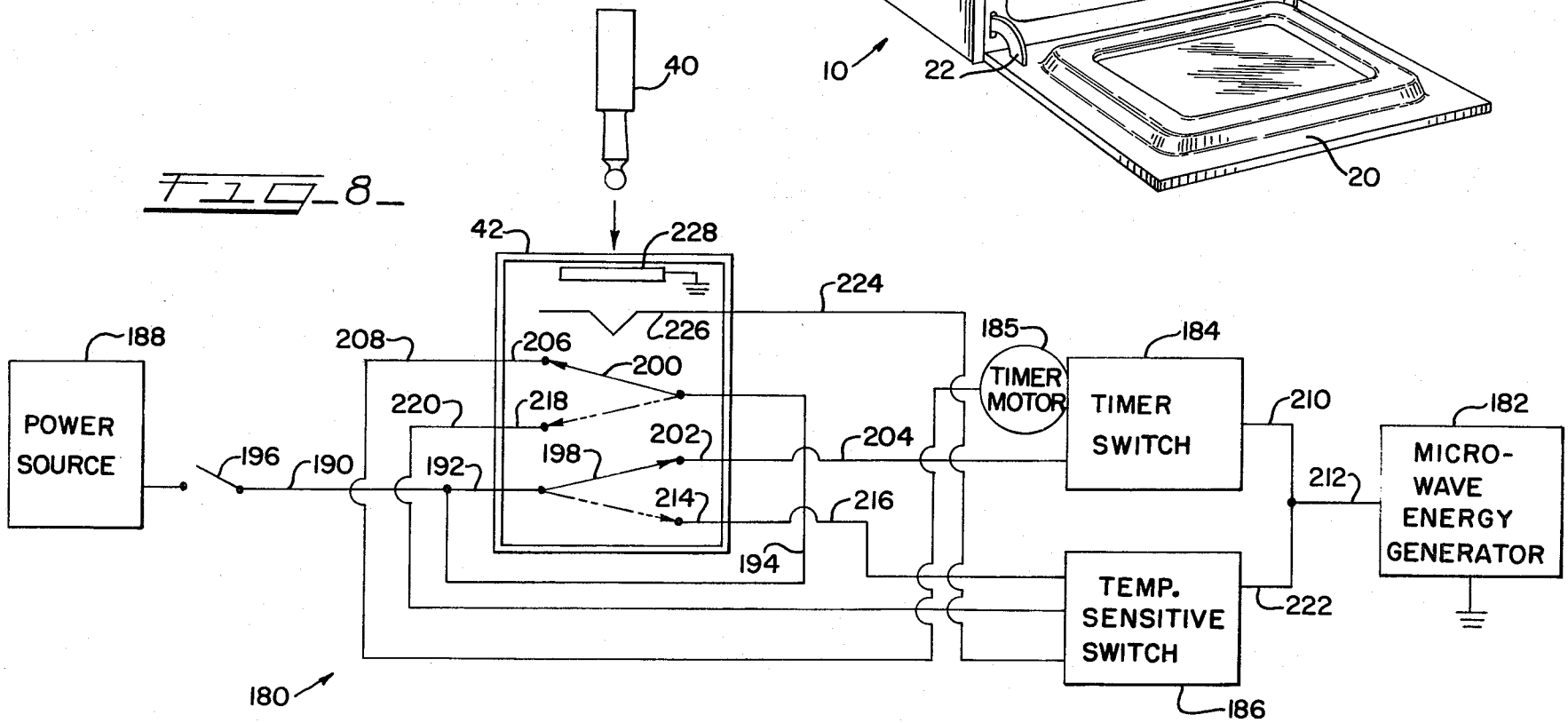
FIG. 8 is a schematic circuit diagram illustrating circuitry which may be used in one embodiment of the present invention, the plug and jack of the invention being in an unmated condition.

Turning now to FIG. 8, circuitry, generally designated at 180, diagrammatically illustrates the circuit transfer apparatus of the present invention in conjunction with the circuitry of a typical microwave oven. As illustrated, the circuitry is such that the microwave oven may be operated in a time-responsive control mode whereby the food within the oven is cooked according to a preset temperature and time; or in a temperature-responsive control mode whereby the food is cooked according to the internal temperature of the food within the oven, utilizing the temperature-sensitive probe and plug arrangement illustrated in FIG. 1. The temperature-responsive control circuitry of the microwave oven is actually responsive to thermally induced changes in the resistance of the thermistor within the temperature-sensitive probe to produce a control effect indicative of the internal temperature of the food. It will be understood that the circuitry 180 is exemplary only and entirely conventional, and may comprise any circuitry of a microwave oven whereby the oven includes control circuitry for temperature-responsive operation and time-responsive operation.

The circuitry 180 operates to energize a microwave energy generator 182 when the cooking temperature and time are preset by a time controlled mode circuitry and switch 184 and timer motor 185, or when the temperature sensed by the temperature-sensitive probe (not shown) as relayed by the plug 40 reaches a preset temperature, the preset temperature being determined by the temperature controlled mode circuitry and switch 186. In addition, a breaker switch 196 is provided so that the entire system is energized or de-energized as the switch 196 is closed or open, respectively. The breaker switch 196 is adapted so that the plug 40 may not be inserted into or withdrawn from the jack 42 unless the switch 196 is open and the power to the energy generator 182 is off.

As illustrated in FIG. 8, the circuitry 180 includes a main circuit 190 which interconnects a prime power source 188 with the jack 42 via conductors 192 and 194, the breaker switch 196 being incorporated in the main circuit 190 to operate as described above. The conductor 192 is connected to a first contact member 198 of the jack 42, and the conductor 194 is connected to another first contact member 200.

When the plug 40 is withdrawn from the jack 42, the first contact member 198 is in its first operating position and is electrically engaged with a second contact member 202 which is connected to the timer switch 184 by a conductor 204. The first contact member 200, likewise in its first operating position, is electrically engaged with a second contact member 206 which is connected to the timer motor 185 by a conductor 208. The time-responsive control circuitry 184 and motor 185 are electrically connected to the microwave energy generator 182 by conductors 210 and 212 so as to operate the microwave oven in its time controlled operating mode, unless the switch 196 is open in which case the power is off.

When the circuitry 180 is in its temperature-responsive operating mode, the first contact member 198 is in its second operating position and is electrically engaged with a second contact member 214 which is interconnected with the temperature sensitive switch 186 via a conductor 216. The first contact member 200 is likewise in its second operating position and is engaged with a second contact member 218 which is electrically connected to the temperature sensitive switch 186 by a conductor 220. The temperature sensitive switch 186 is electrically connected to the microwave energy generator 182 by conductors 222 and 212. Furthermore, in order to integrate the temperature sensing function of the probe 40 into the temperature-responsive control circuitry and switch 186, a conductor 224 leads from the temperature-responsive control circuitry 186 to a retention contact member 226 of the jack 42. When the plug 40 is inserted within the jack 42, the plug 40 electrically engages the retention contact member 226 and the plug receiving means 228 of the jack 42 which leads to ground. Such an insertion of the plug 40 into the jack 42 also throws the first contact members 198 and 200 so that they engage the second contact members 214 and 218, respectively, and the m.e. generator 182 operates in its temperature controlled operating mode unless the switch 196 is open, in which case the power is off.

From the foregoing, it can be seen that the present invention provides for a simple and reliable circuit transfer apparatus for controlling the operating modes of a microwave oven. The circuit transfer apparatus of the present invention includes a novel jack which directly regulates the operating modes of the oven rather than utilizing separate micro switches or transfer circuitry as has been the case previously. Furthermore, the jack of the present invention not only provides for simple and direct control over alternate operating modes, but also reduces the possibility of short-circuiting the main circuits which pass directly through it. In addition, the present invention takes advantage of the automatic power shut-off effected by the breaker switch prior to any switching of the operating modes, thereby enabling the jack of the present invention to be of simple and miniaturized configuration and constructed from inexpensive materials. Finally, the jack of the present invention is capable of carrying high current loads, such as conventional 15 Amp, 110 Volt A.C., without damaging the contact members therein so that the subject jack and the inherent features and advantages thereof may be readily incorporated into most existing microwave ovens without extensive alterations to the circuitry thereof.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein but may be modified within the scope of the appended claims.

I claim:

1. A jack for regulating the time and temperature responsive control circuits of a microwave oven, comprising:

housing means including an orifice for receiving a temperature probe plug therein;

temperature-sensing circuit contact means for electrically engaging said plug within said housing means;

time and temperature responsive control circuit contact means including a plurality of first and second contact members disposed within said housing means, said first contact members being electrically engageable with selected second contact members; and means for electrically isolating said first contact members from one another and including means for translating the insertion and withdrawal movements of said plug into and from said housing means into movements of said first contact members to selectively engage various second contact members to transfer between the control circuits of the oven.

2. The jack as described in claim 1, wherein each said first contact member is a resilient leaf spring contact and is electrically engageable with and movable between two adjacent second substantially stationary contact members to provide two alternate circuit paths for each first contact member of said jack.

3. The jack as described in claim 1, wherein said isolating means comprises insulating spacer means interposed between each of said first contact members, there being one said insulating spacer means interposed between said control circuit contact means and said plug receiving means for engagement with said plug as said plug is inserted into said housing means, said insulating spacer means and said first contact members moving generally simultaneously when said plug is inserted into or withdrawn from said housing means thereby translating the movements of said plug to movements of said first contact members to selectively engage various second contact members.

4. The jack as described in claim 1, wherein said temperature-sensing circuit includes said plug receiving orifice and is electrically integrated with said temperature-responsive control circuit.

5. A jack adapted for a microwave oven having a microwave energy generating means and time-responsive and temperature-responsive control circuitry for operatively controlling said energy generating means, said jack comprising:

a housing having a central cavity and including means for receiving a male plug therein;

means for removably retaining said plug within said cavity when said plug is inserted into said housing, including means for electrically engaging said plug therein;

a plurality of resilient and movable leaf spring contact means each having a free end disposed within said cavity, and a plurality of generally stationary contact means extending into said cavity, each of said stationary contact means having a contact element disposed on its free end within said cavity, said leaf spring and stationary contact means selectively interconnecting the time-responsive and temperature-responsive control circuitry to said energy generating means; and means within said cavity for electrically isolating said leaf spring contact means from one another and including means for translating the insertion and withdrawal movements of said plug into and out of said cavity into movements of said leaf spring contact means to electrically engage the free ends thereof with selected stationary contact means to selectively interconnect the time-responsive and temperature-responsive control circuitry in a predetermined manner.

6. The jack as described in claim 5, wherein said plurality of said stationary contact means are arranged in spaced-apart pairs, the free end of one of said leaf spring contact means being interposed between the free ends of each said stationary contact means pairs for alternate contact therewith.

7. The jack as described in claim 6, wherein said jack includes two of said leaf spring contact means and two pairs of said stationary contact means.

8. The jack as described in claim 7, wherein one of said leaf spring contact means and one pair of said stationary contact means extend from a first sidewall of said housing, and the other leaf spring contact means and the other pair of stationary contact means extend from a second sidewall of said housing, the free end of said one leaf spring contact means is interposed between the contact means of said other pair of stationary contact means, and the free end of said other leaf spring contact means is interposed between the contact means of said one pair of stationary contact means.

9. The jack as described in claim 5, wherein each said leaf spring contact means includes a centrally disposed projecting bead portion for snug engagement with said translating means.

10. The jack as described in claim 5, wherein each said leaf spring and stationary contact means includes a folded portion at one end thereof for extension through and projection outwardly of said housing, each said folded portion including a projecting tab portion for engagement with a channel disposed within the sidewall of said housing.

11. The jack as described in claim 5, wherein said isolating means comprise insulating spacer means interposed between each of said leaf spring contact means, there being one said insulating spacer means interposed between said leaf spring contact means and said plug retention means to engage said plug when said plug is inserted into said housing, said insulating spacer means and said leaf spring contact means moving generally simultaneously when said plug is inserted into or withdrawn from said cavity thereby translating the movements of said plug to movements of said leaf spring contact means to selectively engage various stationary contact means.

12. The jack as described in claim 11, wherein said isolating means further comprise a plurality of flexible members secured to the interior sidewalls of said housing and extending therefrom to at least the central portion of said cavity, said insulating spacer means being carried by said flexible members.

13. The jack as described in claim 12, wherein said insulating spacer means are disposed at the end portions of said flexible members in alignment with said plug receiving means.

14. The jack as described in claim 11, wherein said isolating means further comprise a plurality of flexible members secured to the interior sidewalls of said housing and extending therefrom toward the central portion of said cavity, the interior ends of said flexible members being remote from said insulating spacer means.

15. The jack as described in claim 5, wherein said one isolating means comprises an insulating spacer block having an aperture therein sized and shaped to snugly receive a first leaf spring contact means therethrough, the portion of said block on one side of said aperture being positioned between said first contact means and said plug retention means, and the other portion of said block on the opposite side of said aperture being positioned between said first contact means and an adjacent leaf spring contact means for engagement therewith.

16. The jack as described in claim 5, wherein said housing includes a bottom wall having an inwardly projecting portion substantially aligned with said plug receiving means to limit movement of said leaf spring contact means and said isolating means within said cavity, thereby preventing excessive stress on said leaf spring contact means.

17. The jack as described in claim 5, wherein each of at least two sidewalls of said housing means includes a plurality of laterally extending slots for mounting said leaf spring and said stationary contact means therein, each said slot having a first narrow portion for use in slidingly inserting said contact means into said slot, and a second wider portion adjacent said first portion for receiving and mounting said contact means in said slot, the shoulder between said first and second portions of each slot preventing lateral displacement of said contact means.

18. The jack as described in claim 17, wherein each said slot further includes a substantially perpendicular channel extending therefrom for receiving a tab portion of a contact means to prevent longitudinal displacement of said contact means.

19. A transfer apparatus for interconnecting one of a pair of electrical control circuits of a device, said apparatus comprising:

housing means including an orifice for receiving a plug means therein;

first circuit contact means for electrically engaging said plug within said housing means;

first and second control circuit contact means including a plurality of first and second contact members disposed within said housing means, said first contact members being electrically engageable with selected second contact members; and means for electrically isolating said first contact members from one another and including means for translating the insertion and withdrawal movements of a plug means into and out of said housing means into movements of said first contact members to selectively engage various second contact members to transfer between the control circuits of the device.

20. A transfer apparatus for interconnecting one of a pair of electrical control circuits of a device, said apparatus comprising:

housing means having a central cavity and including means for receiving a male plug therein;

means for removably retaining a plug within said cavity when a plug is inserted into said housing, including means for electrically engaging a plug therein;

a plurality of resilient and movable leaf spring contact means each having a free end disposed within said cavity, and a plurality of generally stationary contact means extending into said cavity, each of said stationary contact means having a contact element disposed on its free end within said cavity, said leaf spring and stationary contact means selectively interconnecting one of the pair of electrical circuits of the device for which said transfer apparatus is adapted; and means within said cavity for electrically isolating said leaf spring contact means from one another and including means for translating the insertion and withdrawal movements of a plug into and out of said cavity into movements of said leaf spring contact means to electrically engage the free ends thereof with selected stationary contact means to selectively interconnect the electrical circuits of the device in a pre-determined manner.

* * * * *